United States Patent [19]

Zimmermann

[11] Patent Number: 4,681,204

[45] Date of Patent: Jul. 21, 1987

[54] DEVICE FOR COUNTING AND SORTING COINS BELONGING TO A SET OF COINS

[75] Inventor: Gert Zimmermann, Berlin, Fed. Rep. of Germany

[73] Assignee: F. Zimmermann & Co., Fed. Rep. of Germany

[21] Appl. No.: 836,170

[22] PCT Filed: May 17, 1985

[86] PCT No.: PCT/DE85/00171

§ 371 Date: Jan. 21, 1986

§ 102(e) Date: Jan. 21, 1986

[87] PCT Pub. No.: WO85/05478

PCT Pub. Date: Dec. 5, 1985

[30] Foreign Application Priority Data

May 22, 1984 [DE] Fed. Rep. of Germany ..... 3419589

[51] Int. Cl.[4] ..... G07D 3/02; G07D 5/10

[52] U.S. Cl. ..... 194/317; 453/32; 453/56; 194/331; 194/334

[58] Field of Search ..... 133/3 R, 3 D, 3 F, 3 H, 133/8 R, 8 A; 194/338, 334, 317, 331

[56] References Cited

U.S. PATENT DOCUMENTS 4,088,144 5/1978 Zimmermann ..... 133/3 F

FOREIGN PATENT DOCUMENTS 2742317 3/1979 Fed. Rep. of Germany ..... 133/3 F

*Primary Examiner*—F. J. Bartuska

*Attorney, Agent, or Firm*—McGlew and Tuttle

[57] ABSTRACT

A device for counting and sorting coins belonging to a set of coins with a guideway 8 tangentially connected to a horizontal coin plate 3 is to be developed for separating foreign coins 11' through a sort-out opening 16. To this end, and behind a coin identifying device 14 and immediately in front of the sort-out opening 16, a diversion element 18 is movably arranged for the coins 11' identified as foreign or counterfeit coins by the coin identification device 14, with its front edge 35 arranged at a distance of at least the width of guide rail 17 from the guiding edge 9, with the diversion element 18 able to be triggered by the coin identification device 14. The diversion element 18, which in its active position is brought into the path of movement of coins 11, 11', diverts the coins from guiding edge 9 by at least a distance that is equal to or greater than the width of guide rail 17. In this manner, the foreign coins 11' to be separated out can drop through the sort-out opening 16. To improve the identification quality, the coin identifying device 14 comprises in addition to an optical fiber bar 31 for identifying diameters, also inductive heads 32, 33 to identification of the alloy of coins 11, 11' and/or for determining the thickness of coins 11, 11'. In addition, further components to identify the milled edge of the coins and their surface structure are arranged downstream.

21 Claims, 10 Drawing Figures

DEVICE FOR COUNTING AND SORTING COINS BELONGING TO A SET OF COINS

FIELD AND BACKGROUND OF THE INVENTION

The present invention related to a device for counting and sorting coins.

In a known device of this kind, a single discharge opening is provided in a moving direction of the coins, behind the sorting-out opening for the coins. The width of the sorting-out opening is adjustable in a direction perpendicular to the guiding edge for the coins. Unsorted coins are transported onto the coin plate of such a device by means of a known vibration chute. The width of the sorting-out opening is adjusted to the diameter of the largest coin to be sorted and counted, so that these coins can pass through the sorting-out opening and only fall out through the adjoining discharge opening as the first kind of coins to be sorted. All the other coins already fall out through the sorting-out opening. They move along the guiding edge by the action of a conveyer belt, and thus are with one edge on the guide rail. However, since the width of the sorting-out opening is greater than the diameter of these coins, the latter are pressed into the sorting-out opening by the action of a spring for supported conveyer belt. Subsequently, the sorted-out, but still unsorted coins are again put on the vibration chute, the width of the sorting-out opening is adjusted to the coin-type whose diameter is the next smaller and the process starts anew. The process is repeated until all the coins belonging to a set of coins are sorted and counted. During each passage, the total value of the coins is determined and shown by a coin identification device. The latter can be composed of a fiber-optical arrangement, for example, such as is known from German Pat. No. 2,547,685 (U.S. Pat. No. 4,088,144).

It is known furthermore that the above process can be executed to perform the counting and sorting of coins belonging to a set of coins in a single passage. For this, a discharge opening for each kind of coin belonging to a set of coins is arranged along the guideway, starting with the discharge opening for the coins with the smallest diameter and ending with the discharge opening for the coins with the largest diameter.

Both these kinds of devices, which operate at high counting and sorting speeds of up to 3,000 coins per minute, have the disadvantage that coins of a foreign currency, which in diameter correspond to a coin-type of the set of coins to be sorted and counted, may be assigned to the respective coin-type and also be included in the value-count. Foreign coins with diameters between the diameters of two coin-types of the set of coins to be counted and sorted are sorted with the coin-type whose diameter is the next largest, yet as a rule are not identified by the coin identification device, so that there is no error in the numerical count, but the false sorting can lead to packages of coin-stacks that are wrong as to their value. Thus, both the known devices are unable to distinguish coins of foreign currencies, coin-like disks and similar objects not belonging to the set of coins to be counted and sorted, from the coins of the desired set of coins. The known devices cannot, in particular, separate these objects from the guideway behind the coin identification device at high operating speed.

SUMMARY OF THE INVENTION

The invention therefore has the object of separating coins identified by the coin identification device and not belonging to the desired set of coins, at high counting and sorting speeds, and furthermore, it has the object of improving the identification quality of the coin identification device.

The solution to this task ensues from the characteristic elements of the claim. According to the invention, those coins and coin-like disks, which do not belong to a coin-type of the set of coins to be sorted and counted, to wit, foreign currency coins and counterfeit money, are diverted by the diversion element from the guiding edge along which they are carried by the action of the conveyor, namely by at least the width of the guide rail on which the peripheral portion of these coins would rest near the guiding edge.

Inasmuch as these coins are no longer supported by the guide rail within the range of the sorting-out opening, these coins fall into the sorting-out opening under the action of the spring supported conveyer belt. At high sorting and counting speed, foreign currency coins and coin-like disks not belonging to the desired set of coins can thus not be sorted out with certainty before being fed to the discharge opening of an appropriate coin-type belonging to the set of coins or to the discharge opening for all the coins belonging to the set of coins.

Diverters of various designs can be used as diversion elements. It is essential, however, that they be able to divert the identified foreign coins and counterfeit coins from the guiding edge by a distance equal to at least the width of the guide rail. The deflection or diversion must be counter to the action of the conveyer belt which is endeavored to carry the coins along in the conveying direction and at the same time press them against the guiding edge. According to the invention, a vertically movable pin is provided as the diversion element, which can be moved onto the guideway from the top, or into the guideway from below. The pin can also be pushed or turned laterally through the guiding edge into the guideway. In a particularly preferred manner, the pin is supported at the end of an L-shaped lever turned at right angles to the guiding edge. To attain a high working frequency, which is necessary at the high counting and sorting speed of 3000 coins per minute, the pin is actuated by a solenoid, particularly a high-speed magnet, which is controlled by the coin identification device.

In addition, the diversion element can be constituted by a switch-like, swing-out part of the guide rail.

Furthermore, an element is provided above the sort-out opening for feeding coins diverted by the guiding edge, particularly large-diameter coins, into the sort-out opening. Although such coins do tip over into the sort-out opening under the action of the spring-supported conveyer belt, they may well become jammed under the conveyer belt at the end of the sort-out opening, given the high operating speed. Preferentially, a cone is provided as the feeder element, whose axis is aligned at right angles to the conveyer track and whose peak is directed towards the guiding edge.

It is additionally provided according to the invention that a coin-stop be associated with the diversion element at the guideway intake, to be actuated by the coin identification device simultaneously with the diversion element. It stops the flow of coins into the guideway concurrently with the actuation of the diversion element, the guides the additional coins back the the coin-plate and/or prevents their continued inflow. In this manner it is prevented that a genuine coin immediately following a foreign coin to be sorted out be also seized by the diversion element and fed into the sort-out opening.

In a manner known as such, the stop is comprised of pins inserted into the guideway from below, which are arranged directly in the intake of the guideway.

Lastly, an umbrella-shaped, curved feeder sheet is provided as feeder element, whose lower edge is arranged at a distance from the guiding edge that is slightly greater than the thickness of the thickest coin, and whose lower edge in the moving direction of the coins is curve-shaped in such a manner that the horizontal distance of the lower edge is initially greater than the diameter of the largest coin and then continuously decreases. When the diversion element is in its active position, i.e., it diverts all coins from the guiding edge by the size of the width of the guide rail, all the coins are surely fed into the sort-out opening by means of the feeder sheet. Only a counting operation will then take place, but no sorting process, since foreign coins remain in the unsorted quantity of coins.

The combination of diversion element and feeder sheet has the particular advantage that one or several specific coin-types, e.g., DM 1.— or DM 2.— coins of the German set of coins, can be sorted out from among the unsorted quantity of coins. These specific coins, after passing the identification process by the coin identification device, steer towards the diversion element, so that these coins can pass freely. Since these coins are not diverted by the guiding edge, these coins can also freely pass the feeder sheet and drop into a sorter-opening, in which thereby only the desired DM 1.— and/or DM 2.— coins are collected.

To improve the identification quality, the coin identification device is provided in addition to the diameter-reading element, which consists of optical fiber bar, with at least one further coin identification element. Thus, according to the invention, an inductive head to identify the alloys of the coins is arranged additionally, in the direction of movement, immediately behind the diameter recognition component. The inductive head measures the attenuation of a high-frequency field through the coin. The electrical conductance and the permeability serve as parameters, from which the characteristics of the alloy of the coins can be determined. According to the invention, an additional inductive head can be used, working with another frequency, in order to separate the two parameters, which serves as a steel-content test.

According to the invention, an additional inductive head is arranged at a distance above the guideway, whose alternating field is also attenuated according to the two parameters, conductance and permeability, but additionally also as a function of the distance to the surface of the coins. The value so determined is divided by the value determined by the alloy recognition. From this, the distance between the inductive head and the surface of the coin is determined. Since the mounting height of the inductive sensing head above the guideway is known, it is then possible to calculate the thickness of the coin.

In an especially preferred manner, the milled edge of the coins moving along the guiding edge is scanned by a narrow light beam in the direction of movement, behind the component for determining the coin thickness. The scanning head for the milled edge is situated behind the guiding edge. The optics focus is located in the plane of the guiding edge. When the coin moves, a characteristic reflection of the light beam is created, which is evaluated. Due to the possible contamination of the coin, the intensity of the reflection is not measured, but only the higher-frequency signal parts are analyzed. The speed of the coins being almost constant, it is possible to deduce a milled edge from the frequency fractions. Thus, a smooth coin delivers frequencies of about 200 to 500 Hz, a milled edge delivers frequencies of about 3000 Hz, the latter, e.g., for a 5-Pence piece. These frequencies are caused by the fact that the coin has a smaller diameter in the milled edge zone therefore travels out of the range of the depth of field of the optical light beam reader, and especially because at the borders of the milled edge the light beam is constantly reflected in other directions. In an additional embodiment, the edge can also be scanned mechanically. The ascertained signal is converted piezoelectrically and evaluated in the manner described above. Lastly, the component for identifying the milled edge is followed by a component for surface structure recognition. In this instance, the surface of the coin is scanned with a miniature inductive head for the coining. The measuring principle is in keeping with thickness-measurement, the interpretation of the measuring correspond to the measurement of the milled edge. The surface structure can alternatively also be determined optically, as with the measurement of the milled edge.

Finally, a determination of the residual magnetism of the coins can be carried through, since all iron-(steel)-coins have a certain residual magnetism which can be measured with a Hall generator.

The process for identifying foreign coins is based on the examination of a group of characteristics of the coins, to wit, diameter, alloy, thickness, milled edge, coining and/or residual magnetism. As a result of each separate test, a value is obtained, which indicates the extent of probability that the coin is a genuine coin which belongs to the desired set of coins. These probability values obtained in all the separate tests are then converted by means of a computing algorithm into a combined probability value which leads to a true/false signal for sort-out. It is particularly important that it is not the individual tests that lead to the true/false signals, but that it is only the combined value that gives the true/false signal. Therefore, the individual tests need not be carried out with great accuracy. Provided only that the number of individual tests is high enough, then based on probability calculus, the result will show very great accuracy. This leads to the effect that when there is an equally high sorting out of foreign and/or counterfeit coins, the share of genuine coins sorted out will become smaller.

The invention is explained in detail hereinfollowing, by means of an exemplified embodiment of a device for sorting and counting coins of a set of coins and for the addition sorting out of foreign coins, as shown in detail in the drawings.

DESCRIPTION OF THE PREFERRED EMBODIMENT

Figure 1:
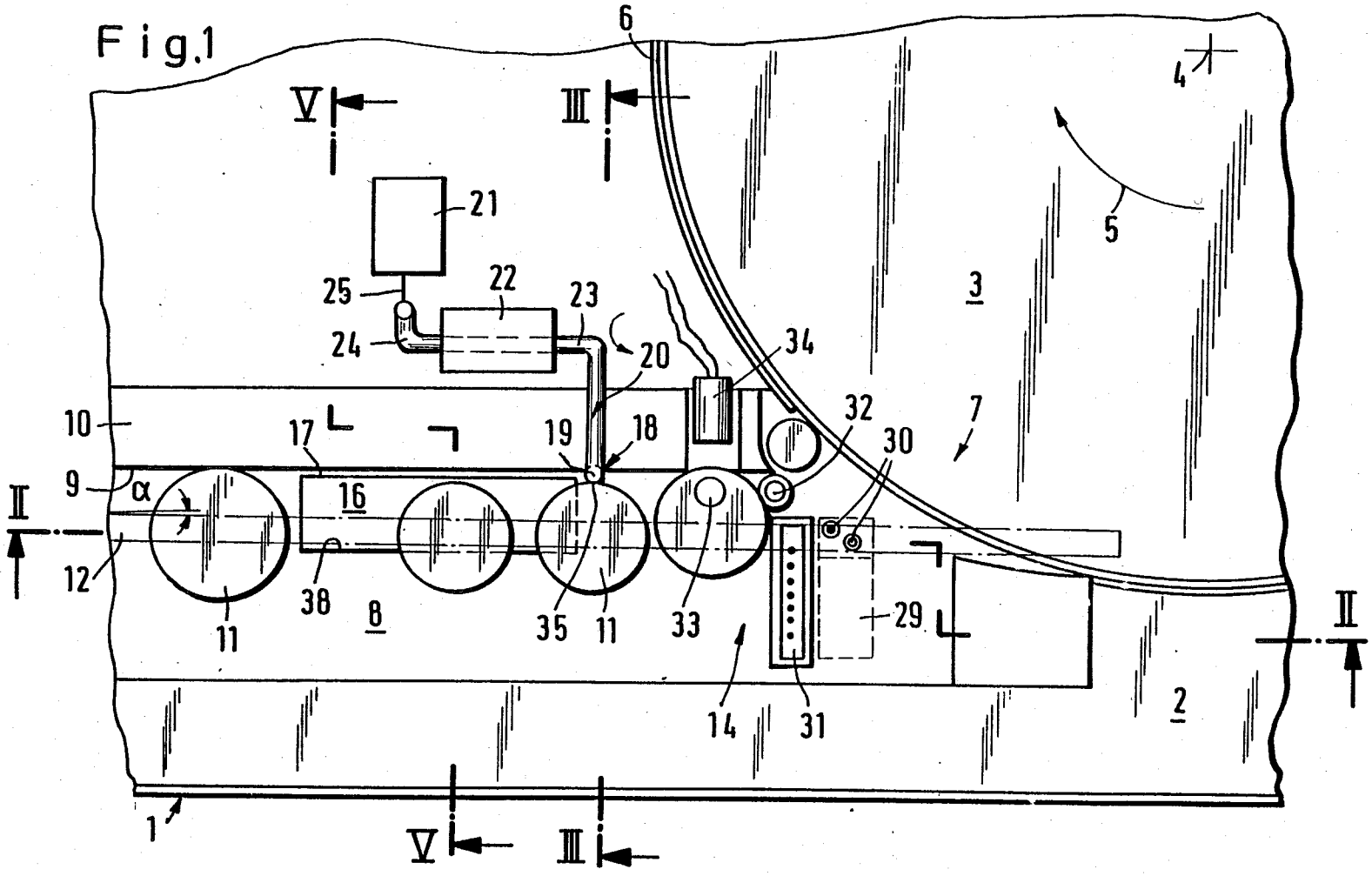
FIG. 1 is a top view of the inventive device having a coin plate and guideway with coin identifying device, sortout opening and diversion element.
Figure 2:
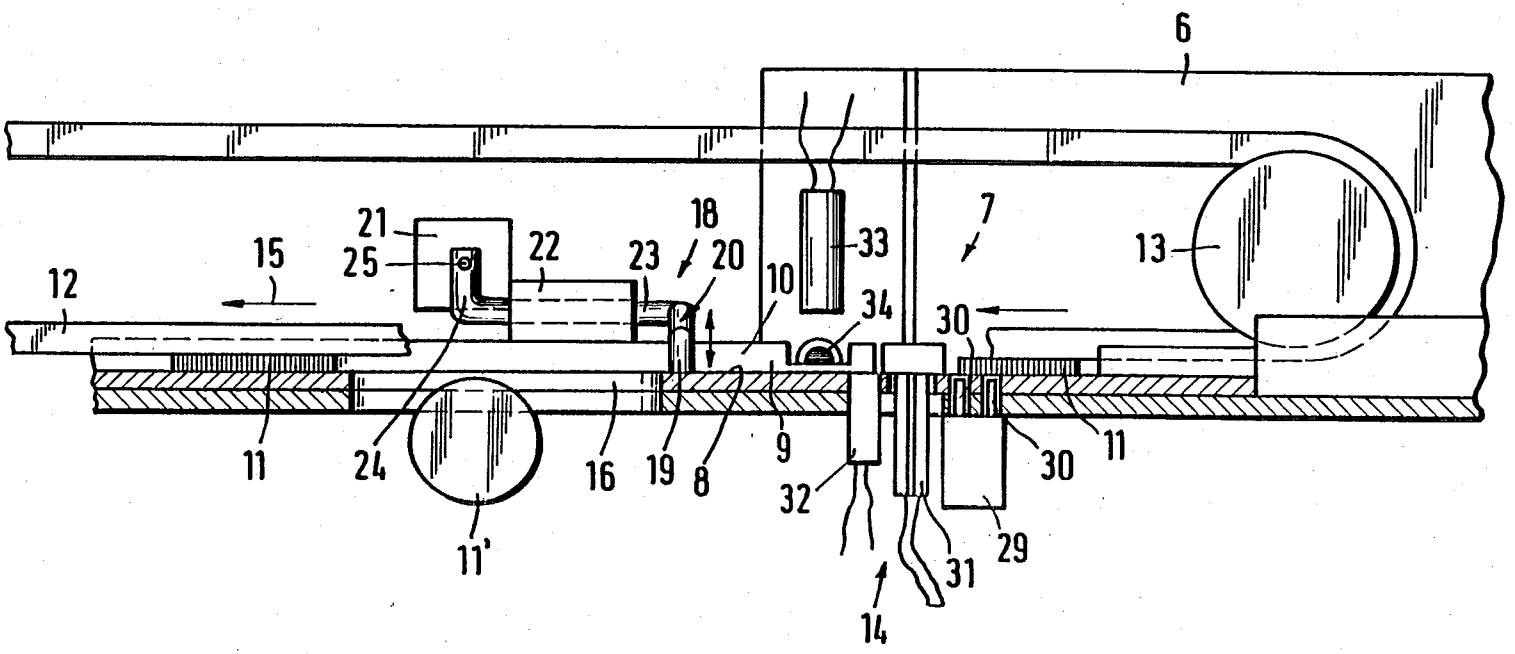
FIG. 2 is a longitudinal section through the guideway along line II—II in FIG. 1.
Figure 5:
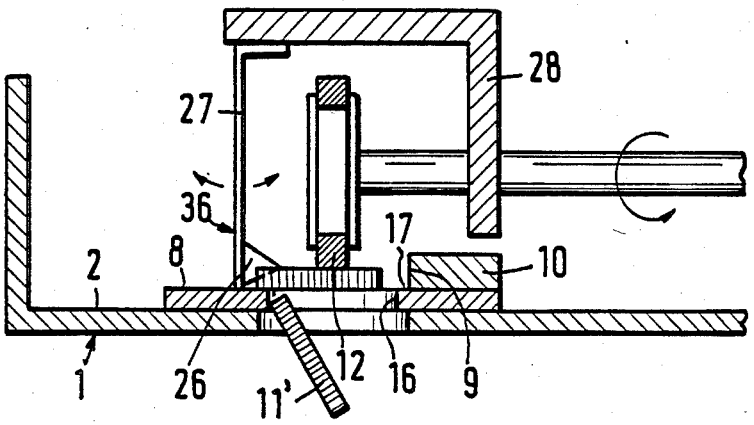
FIG. 5 is a cross-section along line V—V in FIG. 1 with a cone-shaped feeder element.

The device for counting and sorting coins belonging to a set of coins and for the additional separating our of foreign coins is comprised of a frame 1 with a base plate 2 having a top surface (FIG. 1). On it, a horizontal coin plate 3 is pivoted in the direction of arrow 5 in the plane of base plate 2, with axis 4 perpendicular to the plane of projection of FIG. 1, and surrounded by a plate collar 6 firmly mounted on base plate 2, which defines a recess in the area of the feed side 7 of the plate 3. The recess of collar 6 is at the upstream intake end of a in the guideway 8 tangentially adjoining the coin plate 3. Along guideway 8, a conveyer belt 12 extends a a small angle against a guiding edge 9 of a guide rail 10 to carry the coins 11 (FIG. 2). The conveyer belt 12 is guided into the guideway 8 around a deflection roller 13 in the area of feed side 7, which roller is arranged on a mounting 28 pivoting above base plate 2 FIG. 5. A coin identifying device 14 comprising several testing components is arranged at the intake, and behind it a sort-out opening 16 is provided in the direction of movement of the coins 11 (arrow 15) (in FIG. 2). Opening 16 has a guide rail or ledge 17 for the coins (FIGS. 1 and 5), and above which the conveyer belt 12 is spring-supported in a manner not shown in greater detail. The distance of outer edge 38 of sort-out opening 16 from the guiding edge 9 is smaller than the diameter of the smallest coin to be counted 11, 11'.

In the direction of movement of coins 11, behind or downstream of the coin identification device 14 and directly in front of sort-out opening 16, a diversion element 18 is movably arranged, which in the embodiment shown consists of a pin 19 which rests at the end of an L-shaped lever 20 arranged at right angles to guiding edge 9 and which can be actuated by a solenoid 21, especially a high-speed magnet. In the embodiment shown, the L-shaped lever 20 is attached to a rocking shaft 23 pivoting on bearing 22, the other end of which carries a lever arm 24, on which the tappet rod 25 of solenoid 21 is pivoting. The front edge 35 of diversion element 18 is arranged at a distance from the guiding edge 9 that is about equal to the width of the guide rail or ledge 17.

Figure 3:
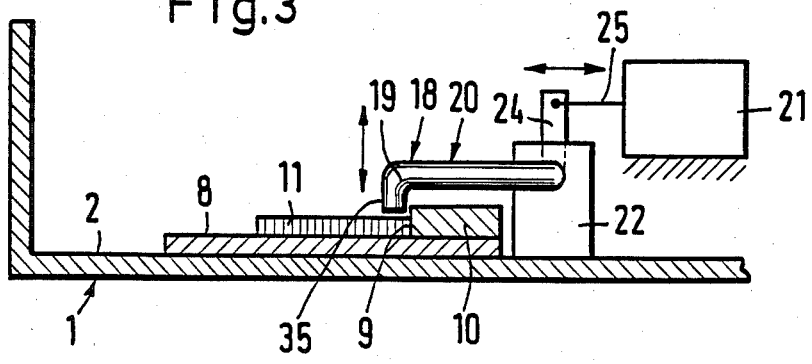
FIG. 3 is a cross-section along line III—III in FIG. 1, in the zone of the diversion element then in the inactive position.

The function of the described diversion element 18 is as follows: So long as the pin 19 of diversion element 18 is in its inactive position as showin in FIG. 3, the coins 11, which are moved along guiding edge 9 of guide rail 10 by means of conveyer belt 12, can pass freely under the diversion element 18. The coins 11 then lie with an edge area on the narrow guide rail 17, which extends directly next to guiding edge 9, and are able to pass the sort-out opening 16, provided the diameter of the coins 11 is greater than the distance of outer edge 24 of sort-out opening 16 from guiding edge 9. Only such coins 11, the diameter of which is smaller than the distance of outer edge 24 of sort-out opening 16 from guiding edge 9, are separated out through the sort-out opening 16.

As soon as the coin identification device 14 has detected a coin 11', which does not belong to the desired set of coins, the diversion element 18 is triggered by the coin identification device 14, i.e., the solenoid 21 is energized. The latter swings the L-shaped lever 20 from its position in FIG. 3 to its position according to FIG. 4, so that pin 19 of the diversion element 18 now reaches into the guideway 8 of coins 11' and diverts the coin 11', which does not belong to the desired set of coins, from the guiding edge 9. Since the front edge of pin 19 is arranged at a distance from guiding edge 9 that is at least equal to the width of guide rail 17, the edge of the coin 11' not belonging to the set of coins turned towards guiding edge 9 now loses its hold on guide rail 17, so that coin 11' can be separated out through sort-out opening 16, even when the other edge of coin 11' extends beyond the outer edge 24 of sort-out opening 16.

The diversion element 18 formed of pin 19 according to the embodiment shown is vertically movable from above onto guideway 8. In a manner not shown in greater detail, the pin 19 can also be arranged vertically movable from below through guideway 8 onto the path of motion of coins 11' that are to be separated out. Pin 19 can also be arranged laterally movable in the guide rail 10 forming guiding edge 9. Finally, the diversion element 18 can also be formed by a switch-like swivelling part of guide rail 10.

Figure 8:
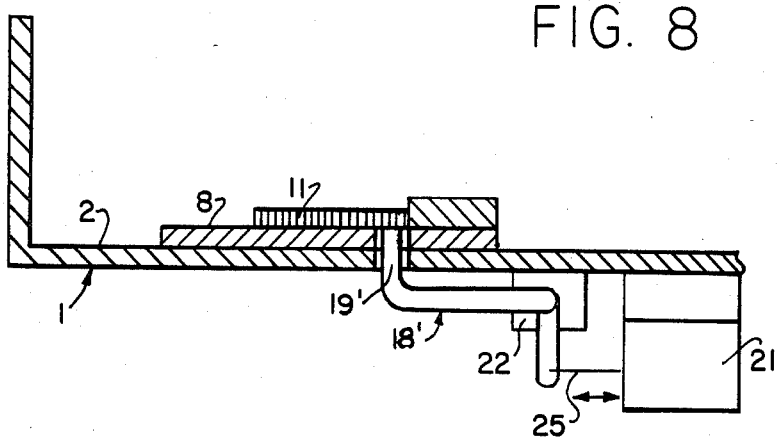
FIG. 8 is a view similar to FIG. 3 but showing an alternate embodiment of the invention.

FIG. 8 illustrates the embodiment with a pin, now shown at 19', is movable from below through the guideway into the path of movement of the coins 11 or 11'. The diversion element 18' of FIG. 8 is pivotally mounted to a bearing 22 as in the embodiment of FIG. 6, and can be pivoted by a solenoid 21 having a tapped rod 25 connected to the pin 19'.

Figure 9:
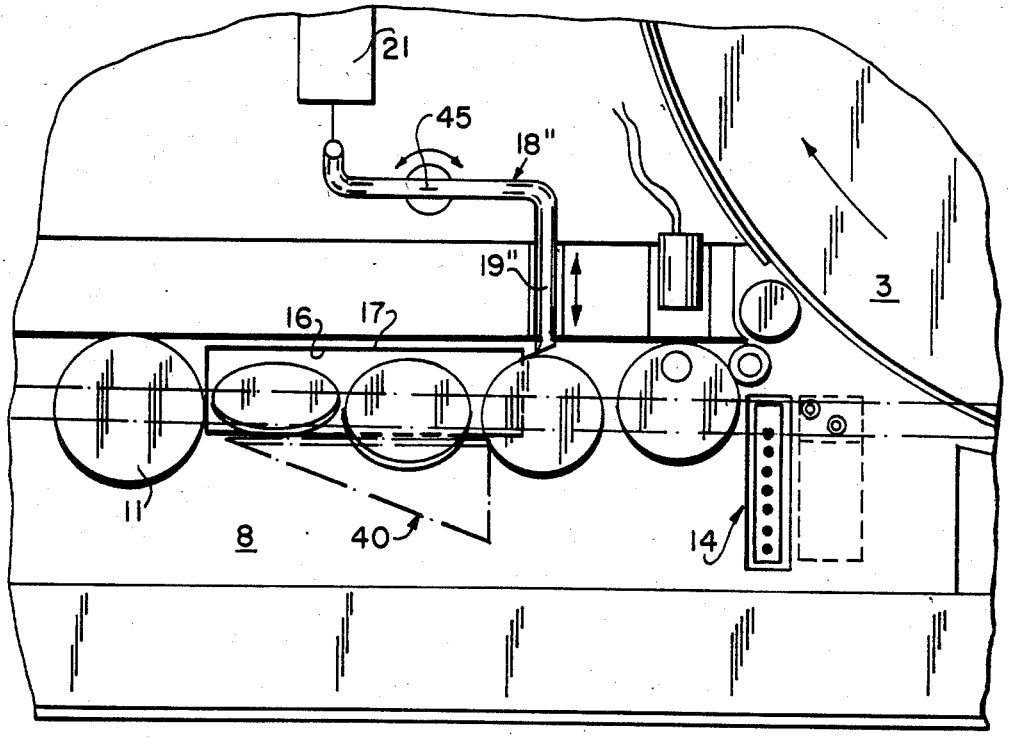
FIG. 9 is a view similar to FIG. 6 showing another embodiment of the invention.

FIG. 9 shows the embodiment wherein the pin 19'' is pivotally mounted at 45 to be movable through the guide rail 10. This diversion element 18'' connected to solenoid 21.

Figure 10:
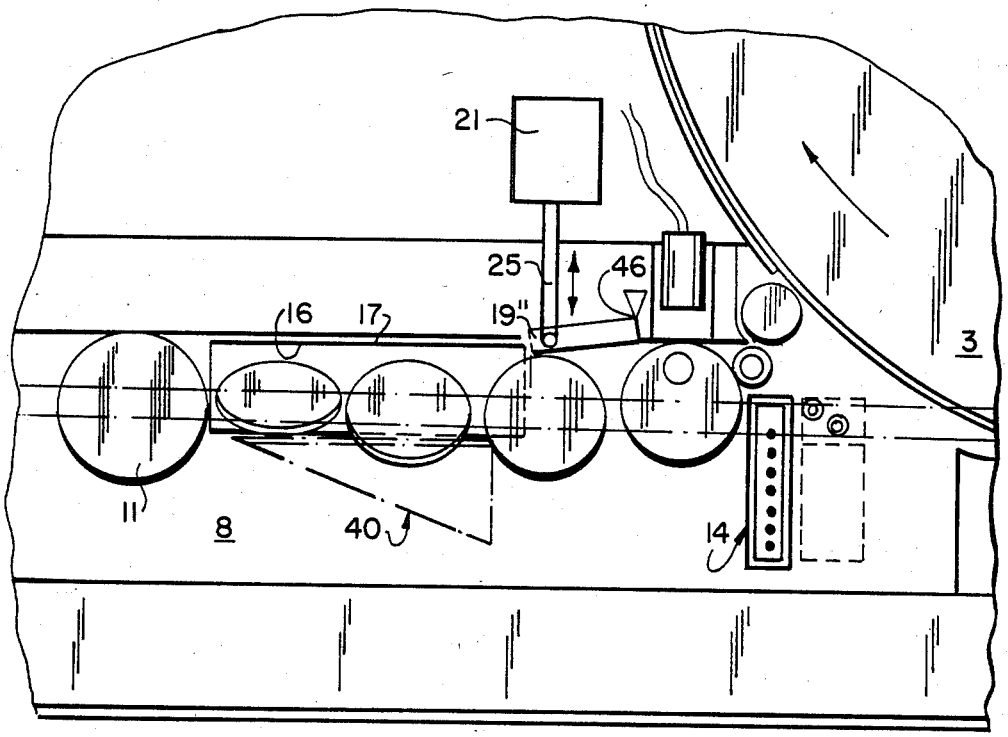
FIG. 10 is a view similar to FIG. 9 showing a still further embodiment of the invention.

FIG. 10 shows the embodiment of the invention wherein the diversion element comprises a switch-like section 19''', pivotally mounted at 46 to the guide rail and actuated by the tappet 25 of a solenoid 21.

In order to ensure that coins 11', which do not belong to the set of coins, with larger diameters will also fall through the sort-out opening 16 after being diverted from guiding edge 9 by means of diversion element 18, an element 36 (FIG. 5) is arranged above the sort-out opening 16 to feed the foreign coins and/or counterfeit coins 11' diverted by diversion element 18 from guiding edge 9. The feeder element 36 is formed by a cone 26, whose axis is at right angles to guiding edge 9 and whose peak is aimed towards guiding edge 9, and which is arranged at the end of a spring arm 27 which in turn is attached to the movable mounting 28 for conveyer belt 12. The coins 11', which have lost their hold on guide rail 17 because of diversion element 18 having swung into its active position, then strike against cone 26, so that these coins 11' are then separated out through sort-out opening 16 by action of the spring supported conveyer belt 12. The other coins 11 which are conveyed over guide rail 17 while resting against guiding edge 9, can avert spring arm 27 and thus pass cone 26 and be fed to a following sorting track by conveyer belt 12. At the feed side 7 to guideway 8, a coin stop 29 is associated with the diversion element 18 and can be actuated together with the diversion element 18 by the coin identification device 14, which coin stop 29 stops the flow of coins into guideway 8 upon actuation of diversion element 18, redirecting the additional coins 11 to the coin plate 3 and/or preventing their intake. The coin stop 29 consists of pins 30, movable from below through guideway 8 into the track of movement of the coins 11; said pins 30 are arranged in the direction of movement of coins 11 in front of coin identification device 8 in the guideway 8.

The diversion element 18 thus has the above described functions:

1. Performance of a pure counting process, with foreign coins 11' being separated out through sort-out opening 16 and genuine coins 11 being collected as an unsorted quantity of coins in a discharge well arranged in guideway 8 behind or downstream of the sort-out opening 16.

2. Performance of a counting process with a subsequent sorting process, with foreign coins 11' again being separated out through sort-out opening 16 and the genuine coins 11 being sorted in a sorting section arranged in the guideway 8 behind the sort-out opening 16 and consisting of several discharge wells each of which is assigned to one type of coin.

Figure 6:
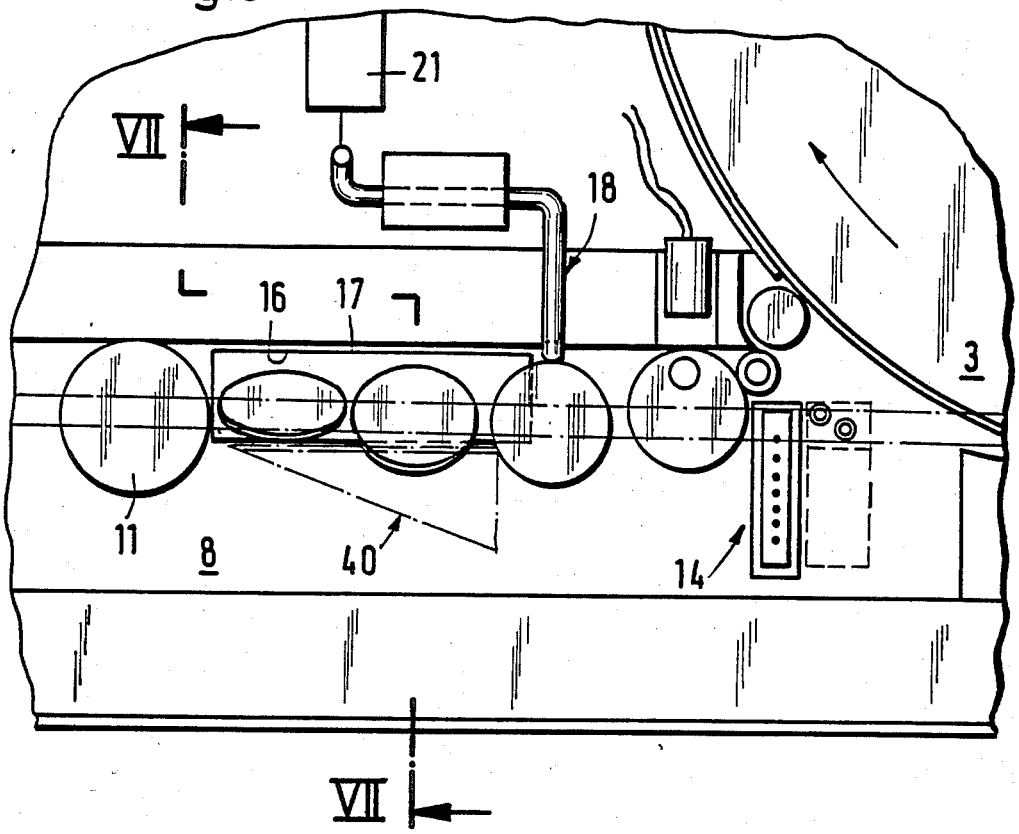
FIG. 6 is a partial top view of the device according to FIG. 1 with an umbrella-shaped arched feeder element.
Figure 7:
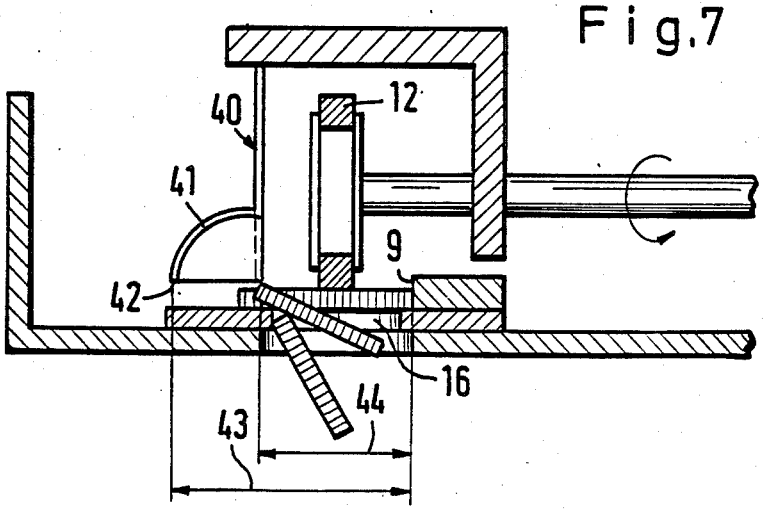
FIG. 7 is a cross-section along line VII—VII in FIG. 6 of the umbrella-shaped arched feeder element.

By way of the below described further development of the invention, shown in FIGS. 6 and 7, two additional functions are made possible. To this end, a feeder element 40 is arranged above sort-out opening 16 to feed the coins 11, 11' diverted from guiding edge 9 by diversion element 18 into the sort-out opening 16, which feeder element 40 is in the form of an umbrella-shaped arched feeder sheet 41, the lower edge 42 of which is arranged at a distance to guideway 8 that is somewhat greater than the thickness of the thickest coin 11, 11', and whose lower edge 42 is shaped in the direction of movement of coins 11, 11' in such a manner that the horizontal distance 43 of lower edge 42 is initially greater than the diameter of the largest coin 11, 11' and then diminishes continually. The smallest distance 44 corresponds approximately to the diameter of the smallest coin 11, 11'.

Figure 4:
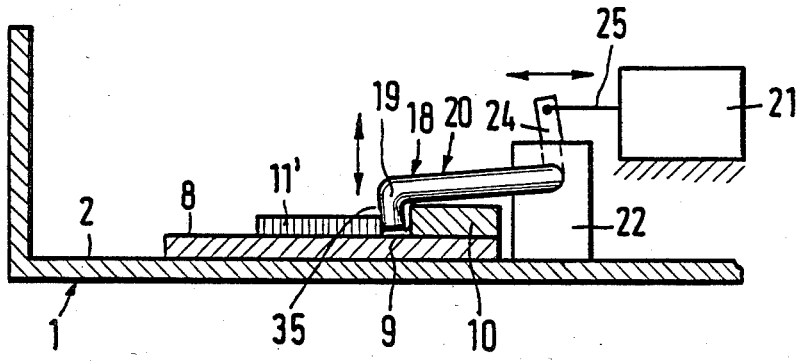
FIG. 4 is a cross-section along line III—III in FIG. 1, in the zone of the diversion element then in its active position.

By this further development of the invention, the following additional functions are made possible:

3. Performance of a purely counting process, with diversion element 18 constantly in its active position as shown in FIG. 4, so that all coins 11, 11', to wit, and genuine coins 11 belonging to the desired set of coins and the foreign or counterfeit coins 11' are fed into the sort-out opening 16 by means of feeder sheet 41. The outer edges of all coins 11, 11' strike against this umbrella-shaped feeder sheet 41, when they are diverted by diversion element 18 that is in its active position from the guiding edge 9 by the amount of the width of guide rail 17 and lose the contact surface for the inner edge situated at guiding edge 9 and tip down into sort-out opening 16.

4. Performance of a counting process and separating out one or more specific coin types, e.g., the DM 1.-coin of the German set of coins. This 4th function corresponds largely to the 3rd function; however, as soon as the coin identification device 14 identifies a coin 11 of the desired coin type, e.g., a DM 1.-coin, the diversion element 18 is raised to its inactive position according to FIG. 3, so that this coin 11 can freely pass both the diversion element 18 and the feeder sheet 41, since the inner edge of this coin 11 rests on guide rail 17 and this coin 11 does not tip down into sort-out opening 16 and thus does not strike against the lower edge 42 of feeder sheet 41.

The coin identification device 14 includes first of all a component 31, mounted in the guideway 8 at right angles to guiding edge 9, which identifies the diameters of the fed coins 11, foreign and counterfeit coins 11', and which is designed as a fiberoptical identification device according to German Pat. No. 2,547,685 (U.S. Pat. No. 4,088,144). In it, optical fibers are arranged at specific small distances from each other at right angles to guiding edge 9 with their ends—which form scanning posts—inside an optical fiber holder inserted in guideway 8, and with their other end connected to photocells, which in turn are connected to a counting device. The free ends of the optical fibers inserted in guideway 8 are illuminated by a light beam element, with a scanning slot for the passage of coins 11 formed between the ends of the optical fibers and the light beam element.

In the direction of movement of coins 11, immediately behind the fiber-optical identification device 31, a component for identifying the alloy is arranged, which is composed of an induction head 32 inserted with flush surface in the guideway 8, which measures the attenuation of a high frequency field through coins 11, 11'. Behind the induction head 32 for identifying alloys, an additional inductive head 33 for identifying the thickness of the coins is arranged above guideway 8; its alternating field is attenuated based on the electrical conductance and the permeability of the material of coins 11, foreign and counterfeit coins 11' and additionally depending on the distance to the coin surface, with the distance of the inductive head 33 to the coin surface being obtained by division of the value ascertained by the value ascertained by the alloy determination, and the thickness of the coin is then determined on the basis of the known mounting height of inductive head 33 above the guideway 8.

The coin identification device 14 is additionally composed of a component 34 for identifying the milled edge of a coin 11, 11'. The component 34 is arranged inside the guide rail 10 and scans the coins 11, 11' moving along guiding edge 9 by means of a narrow light beam, whereat the reflection of the light beam is evaluated. In a manner not further described, a mechanical scanning device for the milled edge of coins 11, 11' can also be provided, which evaluates the vibrations created by the milled edge of coins 11, 11' by means of an electrical or electronic vibration pickup.

Lastly, the coin identification device 14 can also have a miniature induction head mounted above the guideway 8, which scans the surface of coins 11, 11' for coining. The coin identification device 14 can also comprise a component for identifying residual magnetism of the coins, which is measured by a Hall generator.

All the components 31 through 34 of the coin identification device 14 are connected to an electronic coin-value identifying device not further described and additionally to the solenoid 21 for actuating the diversion element 18.

I claim:

1. A device for counting and sorting coins belonging to a set of coins as well as coin-like objects not in the set of coins, comprising:

a horizontal coin plate (3) for receiving coins of the set and coin-like objects not of the set;

a horizontal guideway (8) extending tangentially from said coin plate and having a feed side for admitting coins at said coin plate;

means defining a guiding edge (9) extending along said guide way;

a conveyor belt (12) mounted for movement above said guide way for conveying coins and coin-like objects in a feed direction along a feed path on said guide way from said feed side and for feeding coins and coin-like objects along said guiding rail;

coin identification means (14) disposed adjacent said guide way and near said feed side for identifying coins and coin-like objects on said guide way;

said guide way having a sort-out opening (16*a*) therein downstream of said feed side in said feed direction, said sort-out opening being defined by a guiding ledge (17) extending along said guiding edge (9) with a selected width, and an outer edge (38) extending along said guiding edge, the distance between said guiding edge and said outer edge being smaller than the diameter of a smallest coin in the set of coins;

a diversion element (18) mounted for movement between an inactive position away from said path to an active position in said path, said diversion element having a front edge (35) which is spaced from said guiding edge (9) by at least said selected width of said guiding ledge (17) in said active position, said diversion element being disposed between said identification means and said sort-out opening in said feed direction, said diversion element being operatively connected to said identification means for movement into its active position when said identification means identifies a coin-like object not in the set for deflecting the coin-like object away from said guiding edge, so that the coin-like object drops into said sort-out opening as the coin-like object is moved along said path by said conveyor belt.

2. Device according to claim 1, wherein the diversion element (18) is composed of a pin (19) that is movable in the feed direction of the coins (11, 11').

3. Device according to claim 2, wherein the pin (19) is movable vertically from above onto the guideway.

4. Device according to claim 2, wherein the pin (19") is movable from below through the guideway (8) into the path of movement of the coins (11').

5. Device according to claim 2, wherein the pin (19") is arranged laterally movable in a guide rail (10) forming the guiding edge (9).

6. Device according to claim 2, wherein the pin (19) is arranged at the end of an L-shaped lever (20) aligned at right angles to the guiding edge (9).

7. Device according to claim 2, wherein the pin (19) is actuated by a solenoid.

8. Device according to claim 1, wherein the diversion element (18) is formed by a switch-like swivelling part (19"') of a guide rail defining said guiding edge (9).

9. Device according to claim 1, wherein therein that above the sort-out opening (16), a feeder element (36, 40) is arranged to feed the coins (11, 11'), diverted from the guiding edge (9) by means of the diversion element (18), into the sort-out opening (16).

10. Device according to claim 9, wherein the feeder element (36) is a cone (26), the axis of which is aligned at right angles to the guiding edge (9) and its peak is aligned towards the guiding edge (9).

11. Device according to claim 1, including a coin stop (29) arranged in the feed side (7) of the guideway (8) associated with the diversion element (18) for actuation at the same time as the diversion element.

12. Device according to claim 9, wherein the feeder element (40) is an umbrella-shaped arched feeder sheet (41), the lower edge (42) of which is arranged at a distance to the guideway (8) that is slightly greater than the thickness of a thickest coin, with a curved shape in the feed direction of the coins in such a manner that the horizontal distance of the lower edge (42) is at first greater than the diameter of the largest coin and then diminishes continually in the feed direction.

13. Device according to claim 1, wherein said coin identification means comprises a first component for identifying the diameter of the coins and objects, which first component is in the form of a fiber-optic identification device, and a second component for identifying the alloy of the coins and objects arranged downstream of the first component in the feed direction of the coins.

14. Device according to claim 13, wherein the second component is composed of an inductive head inserted in the guideway, which measures the attenuation of a high frequency field through the coins (11, 11').

15. Device according to claim 1, wherein said identification means comprises a first component for identifying the thickness of the coins and objects and a second component for sensing the alloy of the coins and objects.

16. Device according to claim 15, wherein the first component for identifying the thickness of the coins (11, 11') is an inductive head (33) arranged above the guideway (8), an alternating field of which is attenuated by virtue of the electric conductivity and permeability of the material of the coins (11) and objects (11') and additionally depending on the distance of the coin surface, with the distance of the inductive head from the coin surface determined by the division of the obtained value by the value determined by the alloy determination, and with the thickness of the coin then being determined on the basis of the height at which the inductive head (33) has been mounted above the guideway (8).

17. Device according to claim 15, wherein the coin identification means (14) additionally has a component for identifying the milled edge of a coin (11, 11').

18. Device according to claim 17, wherein the component for identifying the milled edge is arranged laterally of the guiding edge (9) within a guide rail (10), defining the guiding edge and the coins (11,11') moved along the guiding edge is scanned by means of a narrow light beam, in the course of which the reflection of the light beam is evaluated.

19. Device according to claim 17, wherein the component for identifying the milled edge of the coins (11, 1') is a mechanical scanning device which evaluates a scanning frequencies as electromagnetic vibrations.

20. Device according to claim 15, wherein the coin identification means (14) additionally has a miniature inductive head above the guideway (8), which scans the surface of the coins.

21. Device according to claim 15, wherein the coin identification means (14) has a component for identifying the residual magnetism of the coins.

* * * * *